US008672286B2

(12) United States Patent
Darré et al.

(10) Patent No.: US 8,672,286 B2
(45) Date of Patent: Mar. 18, 2014

(54) ADJUSTABLE WALL HANGER

(76) Inventors: Laura Darré, Washington, NC (US); Kathryn Pisciotta, Washington, NC (US)

( * ) Notice: Subject to any disclaimer, the term of this patent is extended or adjusted under 35 U.S.C. 154(b) by 0 days.

(21) Appl. No.: 13/418,254

(22) Filed: Mar. 12, 2012

(65) Prior Publication Data

US 2013/0233992 A1 Sep. 12, 2013

(51) Int. Cl.
*A47G 1/24* (2006.01)
*B60R 1/02* (2006.01)

(52) U.S. Cl.
USPC ..... 248/477; 248/480; 248/476; 248/495; 33/613; 33/666

(58) Field of Classification Search
USPC ..... 248/480, 475.1, 476, 477, 478, 489, 248/495, 496, 497, 466, 470, 479, 323, 327, 248/339; 33/613, 666
See application file for complete search history.

(56) References Cited

U.S. PATENT DOCUMENTS

| | | | | | |
|---|---|---|---|---|---|
| 427,461 | A | | 5/1890 | Crider | |
| 545,774 | A | * | 9/1895 | Clark | 248/59 |
| 707,941 | A | * | 8/1902 | Pope | 248/48.1 |
| 1,107,686 | A | | 8/1914 | Mehrmann | |
| 1,264,837 | A | * | 4/1918 | Moen | 248/297.21 |
| 1,294,916 | A | | 2/1919 | Knight | |
| 1,755,453 | A | * | 4/1930 | Mullen | 248/48.1 |
| 2,478,256 | A | * | 8/1949 | Eysmann | 248/496 |
| 2,569,622 | A | * | 10/1951 | Trainor | 248/477 |
| 2,614,471 | A | | 10/1952 | Markowitz | |
| 2,681,194 | A | | 6/1954 | Halvorsen | |
| 2,697,572 | A | | 12/1954 | Pfankuch | |
| 2,920,853 | A | | 1/1960 | Bufogle | |
| 2,975,994 | A | * | 3/1961 | Goss | 248/496 |
| 3,360,229 | A | | 12/1967 | Beyer | |
| 3,664,626 | A | | 5/1972 | Sneller | |
| 4,557,455 | A | * | 12/1985 | Benjamin | 248/496 |
| 4,826,210 | A | * | 5/1989 | Schmidt | 280/808 |
| 5,100,094 | A | | 3/1992 | Handwerger | |
| D349,447 | S | | 8/1994 | Daniller | |
| 5,853,222 | A | * | 12/1998 | Roslund et al. | 297/353 |
| 6,152,418 | A | | 11/2000 | Panicci | |
| 6,299,123 | B1 | * | 10/2001 | Hayde | 248/476 |
| 6,666,425 | B1 | * | 12/2003 | Ferguson | 248/477 |
| 6,802,089 | B2 | * | 10/2004 | Cropelli | 4/570 |
| 7,100,248 | B2 | * | 9/2006 | Crook | 24/16 PB |
| 7,222,833 | B2 | * | 5/2007 | Yang | 248/493 |
| 7,578,492 | B2 | | 8/2009 | Darré | |
| 7,677,521 | B2 | * | 3/2010 | Price | 248/475.1 |
| 8,011,635 | B2 | * | 9/2011 | Aleo | 248/476 |
| 8,028,429 | B2 | * | 10/2011 | Mears | 33/429 |
| 8,356,777 | B2 | * | 1/2013 | Miles et al. | 248/59 |
| 2010/0096532 | A1 | | 4/2010 | Greve | |
| 2012/0056051 | A1 | * | 3/2012 | Gold | 248/222.14 |

* cited by examiner

*Primary Examiner* — Nkeisha Smith
(74) *Attorney, Agent, or Firm* — Jones IP Law, LLC; Dennis W. Jones

(57) ABSTRACT

An adjustable wall hanger includes (1) an elongated bracket with a front surface including markings and a rear surface including serrations, (2) mounting members near each end of the elongated bracket, (3) an elongated slot, (4) a hook assembly including a hook member secured by a hook fastener, including a hook portion distal from a clamp portion including a planar section, jaws, and a cam, and the hook fastener includes a base with a post, serrated teeth, and lugs extending from the post, the post including detents between the base and lugs, wherein closed configuration includes the hook member against the front surface to lock the hook assembly in position, and open configuration includes the planar surface against the front surface so that the hook assembly is movable, and the lugs fit within the jaws to secure the hook member to the fastener and to the elongated bracket.

16 Claims, 4 Drawing Sheets

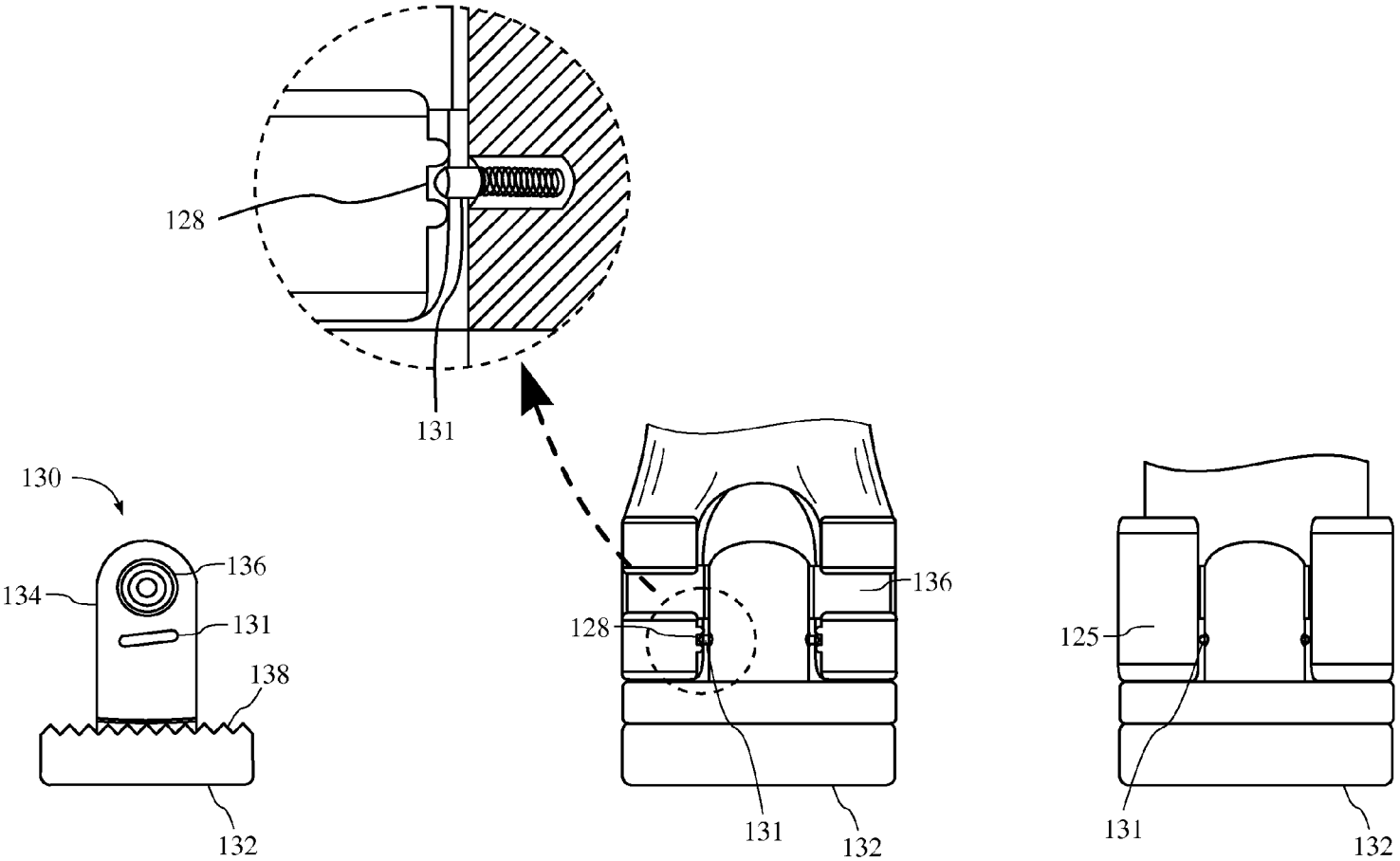
Fig. 3-C
Fig. 3-B
Fig. 3-A

ADJUSTABLE WALL HANGER

BACKGROUND

1. Field of Invention

This invention relates to hangers for pictures, tools, utensils, and more particularly to an adjustable hanger.

2. Description of the Related Art

Wall hanging of pictures, such as in the home, is accomplished most often by use of a metal hook having a vertical shank, and a roughly triangular nail holder at the top of the shank which permits a nail to be driven into the wall in an angular or toed orientation. Where a particular pattern of framed pictures, such as in a straight horizontal array, is desired, precise measurements are necessary to achieve a linear alignment of the hangers. Some compensation for a failure to achieve precise alignment or position can be had by increasing or decreasing the slack in the usual hanging wire which extends across the rear of the frame. However, it often happens that misalignment is substantial, and cannot thus be remedied. In such case, the hanger itself must be repositioned, necessitating creating a new nail hole, and leaving an unsightly empty hole in the wall.

BRIEF SUMMARY

According to one embodiment, an adjustable wall hanger includes (1) an elongated bracket with a front surface including markings and a rear surface including serrations, (2) mounting members near each end of the elongated bracket, (3) an elongated slot, (4) a hook assembly including a hook member secured by a hook fastener, including a hook portion distal from a clamp portion that includes a planar section, jaws and a cam opposite the jaws, and the hook fastener includes a base with a post and serrated teeth, and lugs extending from the post, and the post including detents between the base and lugs, wherein a closed configuration includes the hook member against the front surface, wherein the cam engages to compress the serrated teeth to the serrations to lock the hook assembly in position, and an open configuration includes the planar surface against the front surface so that the hook assembly is movable, and the lugs fit within the jaws to secure the hook member to the fastener and to the elongated bracket.

According to another embodiment, an adjustable wall hanger comprises an elongated bracket with a front surface and a rear surface, the front surface including marks for position guidance, and the rear surface including serrations, a mounting member near at least one end of the elongated bracket, and including a hole to receive a fastener for affixing the adjustable wall hanger to a fixed surface, an elongated slot extending a portion of the distance between each end of the elongated bracket. A hook assembly includes a hook member and a hook fastener. The hook member has adjustable configurations and includes a hook portion distal from a clamp portion that includes jaw sections separated by an opening, each with at least two jaws, and the clamp portion includes a planar section near the jaws. The hook fastener includes a base with a post extending therefrom. The base includes serrated teeth near the post. Lugs extend from opposite sides of the post and distal from the base. The post includes at least one detent between the base and the lugs.

The adjustable configurations include a closed configuration and an open configuration. The closed configuration includes the hook member against the front surface and so that a cam opposite the jaws is operable to compress the serrated teeth against the serrations to lock the hook assembly in position. The open configuration includes the planar surface against the front surface so that the hook assembly is movable along the elongated slot. The post extends through the elongated slot so that the lugs fit within the jaws to secure the hook member to the fastener and to the elongated bracket.

In another embodiment, the detent further includes means for spring functionality so that the detent is compressible within the post and rests in an extended position when uncompressed.

Another embodiment includes a groove on at least one jaw, wherein the groove aligns with the detent to lock the hook member in an open position.

In another embodiment each mounting member is angled so that a fastener extending through the hole forms an angle of substantially 60° relative to the elongated bracket.

In another embodiment, the fastener is one a group comprising a nail, a screw, a bolt.

Other systems, methods, features and advantages of the present invention will be or become apparent to one with skill in the art upon examination of the following drawings and detailed description. It is intended that all such additional systems, methods, features and advantages be included within this description and be within the scope of the present disclosure.

BRIEF DESCRIPTION OF THE SEVERAL VIEWS OF THE DRAWINGS

The above-mentioned features will become more clearly understood from the following detailed description read together with the drawings in which:

FIG. 3-A is a side view of a hook fastener of the adjustable wall hanger of FIG. 1, FIG. 3-B is a view of a detent in an extended position, and FIG. 3-C is a view of the detent in a compressed position.

DETAILED DESCRIPTION

An adjustable wall hanger 100 for hanging pictures, tools, utensils, and the like on a wall or other flat surface is disclosed. The adjustable wall hanger 100 provides for adjustment of the height of a picture or other object without removing the adjustable wall hanger from the wall.

Figure 2:
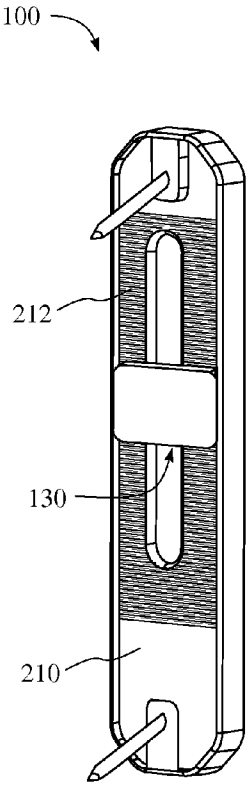
FIG. 2 is a rear perspective view of the adjustable wall hanger of FIG. 1.
Figure 1:
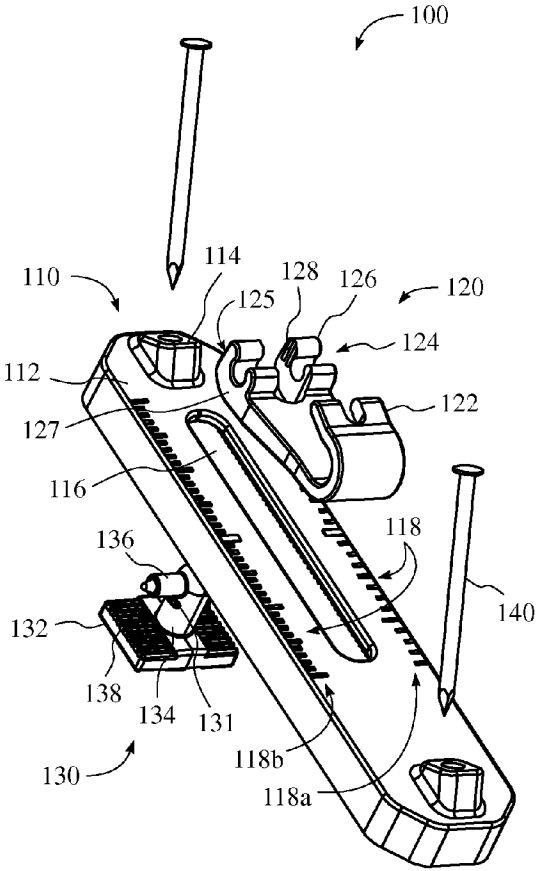
FIG. 1 is a front perspective exploded view of an adjustable wall hanger.

FIG. 1 is a front perspective exploded view of an adjustable wall hanger 100. FIG. 2 illustrates a rear perspective view of the adjustable wall hanger 100. In the illustrated embodiment, the adjustable wall hanger 100 includes an elongated bracket 110, a hook member 120, and a hook fastener 130. The adjustable wall hanger 100 is affixed to a flat surface, such as a wall for example, via one or more fasteners 140. In the illustrated embodiment, the fasteners 140 are nails. Those skilled in the art will recognize that screws, bolts, and the like can be used as fasteners 140 without departing from the spirit and scope of the present invention. The respective components of the adjustable wall hanger 100 are assembled from materials providing sufficient strength for supporting the materials to be hung.

In some embodiments, at least a portion of the components of the elongated bracket 110, and/or the hook member 120, and/or the hook fastener 130 are manufactured via an injection molding process. Such an injection molding process is used for example to provide polymers and other plastic materials, such as thermosetting plastic materials. The elongated bracket 110, for example, is typically manufactured via an injection molding process to produce a thermoplastic material. In one embodiment the elongated bracket 110 is manufactured via injection molding into a single piece. Similarly, in one embodiment, the hook member 120 is manufactured via injection molding into a single piece.

The elongated bracket 110 has a front surface 112, a rear surface 210, mounting members 114, and an elongated slot 116. In one embodiment the elongated bracket 110 is manufactured via injection molding so that the front surface 112 is a substantially smooth surface to provide for easy sliding of other components of the adjustable wall hanger 100 along the front surface 112. For example, in one configuration discussed below the hook member 120 slides or glides along the front surface 112 during adjustment.

Mounting members 114 are located at either end of the elongated bracket 110. The mounting members 114 include a hole for receiving the fasteners 140. When affixing the adjustable wall hanger 100 to a wall or other flat surface, a fastener 140 extends through the holes of each mounting member 114 and into the flat surface. In one embodiment, the mounting members 114 include a surface oriented at an angle to the front surface 112 of the elongated bracket 110. In such an embodiment, the orientation of the mounting members 114 is such that the fasteners 140 form an angle approximately 60° relative to the elongated bracket 110. In other embodiments, the fastener angle relative to the elongated bracket 110 is at angles other than 60°. In yet other embodiments, the mounting member 114 includes only the hole for receiving the fasteners 140, wherein the holes are oriented at an angular relation to the elongated bracket 110.

The elongated slot 116 extends through the body of the elongated bracket 110 from the front to the rear. The elongated slot 116 extends lengthwise between the mounting members 114 of the elongated bracket 110. The front surface 112 includes at least one group of markings 118 adjacent to the elongated slot 116. In one embodiment, the front surface 112 includes markings 118 laterally adjacent to the elongated slot 116 on both sides. In such an embodiment, the markings 118 include English unit markings 118*a* and metric unit markings 118*b*. Those of skill in the art will readily appreciate that the markings 118 may be reversed from the above locations and descriptions, and further that a group of markings may also be spaced in a manner other than specific measurements. The rear surface 210 of the elongated bracket 110 includes serrations 212 adjacent to either side of the elongated slot 116, and extending beyond both ends of the elongated slot 116.

The hook member 120 and the hook fastener 130 connect to form a hook assembly that extends through the elongated slot 116. The hook member 120 includes a clamp 124 at one end and a hook portion 122 at the other end. The clamp 124 includes jaws 126, a hook plane 125, and a cam 127. The hook member 120 is operable as a lever for securing or releasing the hook assembly from the elongated bracket 110. For example, the hook member 120 is operable as a lever for releasing the hook assembly to adjust the position of the hook assembly on the elongated bracket 110. Adjustment of the hook assembly is discussed in further detail below.

The clamp 124 includes two pairs of jaws 126 with an opening within each pair of jaws 126 and an opening between the two pairs of jaws 126 to which the opening within each pair of jaws 126 also connects and extends through. A hook plane 125 is at the end of the clamp 124 and distal from the hook portion 122. That is, each jaw 126 at the end of the hook member 120 includes a hook plane 125 on the side of the jaw 126 opposite the hook portion 122. The hook plane 125 is a flat surface at the end of the hook member 120. In one embodiment the hook member is manufactured via injection molding so that the hook plane 125 is a substantially smooth surface to provide for easy sliding of the hook member along the front surface 112. For example, in one configuration discussed below the hook member 120 slides or glides along the front surface 112 during adjustment.

The hook member 120 includes a groove 128 on the inside of the jaws 126 distal from the hook portion 122. That is each jaw 126 at the end of the hook member 120 includes a groove 128 on the inside of the jaw 126 at the opening between the pair of jaws 126. In one embodiment, the groove 128 is between two raised portions on the inside of each respective jaw 128. In one embodiment, the clamp 124 is a single piece that includes the jaws 126 and the respective grooves 128. That is the clamp 124 is manufactured to be a single piece that includes the respective jaws 126 and grooves 128 in a single mold, formation, etc.

The cam 127 portion is an irregular shaped portion of the clamp 124 opposite the openings within and between the jaws 126. The cam 127 is used to lock or secure the clamp 124 in place along the elongated slot 116 of the elongated bracket 110.

The hook fastener 130 includes a base 132, a post 134, lugs 136 and serrated teeth 138. The post 134 extends distally from the base 132. Two lugs 136 extend or project from opposite sides of the post 134 and distal to the base 132. The base 132 includes serrated teeth 138 proximal to the post 134. The post 134 includes at least one detent 131 between the base 132 and a lug 136. Each detent 131 corresponds to a groove 128 in the jaw 126 at the end of the hook member 120. The respective detent 131 and groove 128 are constructed to align in a manner that snaps the hook member 120 into an open or disengaged configuration.

When affixing the hook assembly to the elongated bracket 110, the post 134 extends through the elongated slot 116 so that the lugs 136 fit within the opening within each pair of jaws 126 of the clamp 124. For assembly, the hook fastener 130 is adjusted so that the lugs 136 align with the elongated slot 116, and the post 134 is inserted through the elongated slot 116 from the rear surface 210 of the elongated bracket 110, whereupon the hook fastener 130 is adjusted or turned so that the lugs 136 are substantially perpendicular to the elongated slot 116. The serrated teeth 138 fit within the serrations 212 of the rear surface of the elongated bracket 110. Once the lugs 136 are securely fitted within the opening in each pair of jaws 126 of the clamp 124, and the serrated teeth 138 are snugly fitted to the serrations 212 of the rear surface 210, the hook assembly is secured to the elongated bracket 110.

Figure 5:
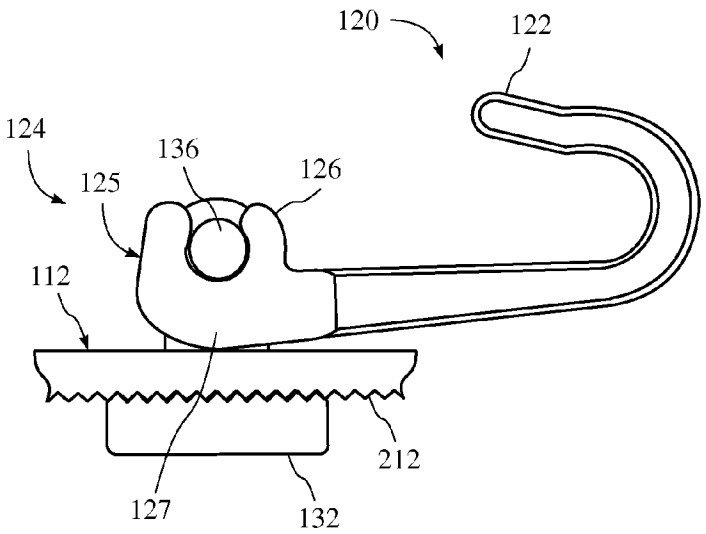
FIG. 5 is a side view of the hook assembly of the adjustable wall hanger of FIG. 1 with the hook portion in an engaged configuration.
Figure 4:
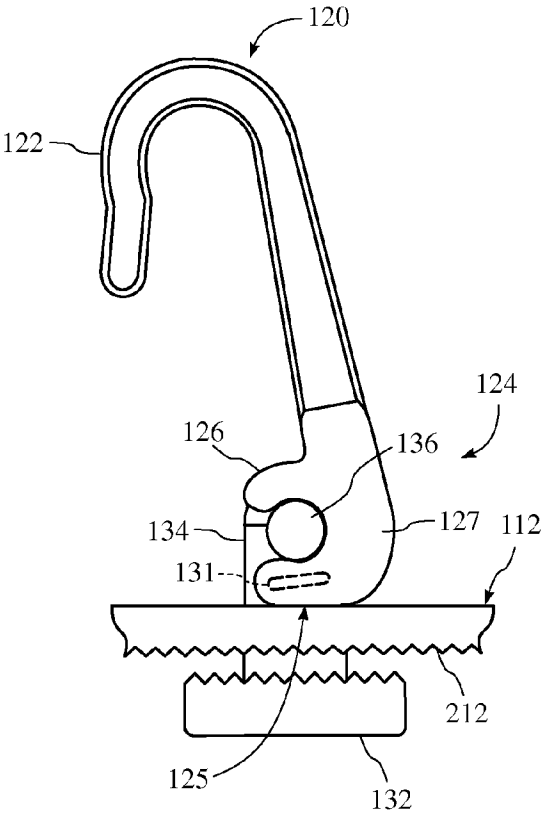
FIG. 4 is a side view of a hook assembly of the adjustable wall hanger of FIG. 1 with the hook portion in a released configuration.

FIG. 3-A is a side view of the hook fastener 130, FIG. 3-B is a view of the hook fastener 130 with the hook member 120 in an open configuration, and FIG. 3-C is a view of the hook fastener 130 with the hook member 120 in a closed configuration. FIG. 4 is a side view of the hook assembly with the hook member 120 in an open configuration. FIG. 5 is a side view of the hook assembly with the hook member 120 in a closed configuration. Together, FIG. 3-A, FIG. 4, and FIG. 5 illustrate the opening and closing of the hook member 120 in concert with the hook fastener 130. The hook assembly is operable to adjust the position of the hook member 120 along the front surface 112 of the elongated bracket 110.

The hook fastener 130 includes a base 132 with serrated teeth 138 proximal to a post 134 that extends distally from the base 132. The serrated teeth 138 correspond to the serrations 212 along the rear surface 210 of the elongated bracket 110. When the hook fastener 130 is secured snugly to the hook member 120, the serrated teeth 138 fit snugly to the serrations 212. The hook fastener 130 includes two lugs 136 that project from opposite sides of the post 134. The lugs 136 are distal from the base 132 and correspond to the openings in each pair of jaws 126 of the hook member 120.

As noted above, the post 134 includes at least one detent 131 between the base 132 and the lugs 136. In the illustrated embodiment, the post 134 includes a detent 131 on each side of the post 134 between the base 132 and the corresponding lug 136. Each detent 131 corresponds to a groove 128 in the jaw 126 at the end of the hook member 120. The respective detent 131 and groove 128 are constructed to align in a manner that snaps the hook member 120 into place for an open configuration. That is, when the hook member 120 is in an open configuration, the detents 131 are engaged with the groove 128 on the jaws 126 of the clamp 124 portion of the hook member 120.

In one embodiment, each detent 131 includes spring functionality. In such an embodiment, the detent 131 is maintained in an open or extended position and returns to the open position via the spring functionality upon being released from compression. In one embodiment the detent 131 is a keeper pin, as illustrated in FIG. 3-B. A keeper pin presses in when pushed and springs back into position when the pressure is removed. The callout area of FIG. 3-B illustrates an exemplary detent 131 where the keeper pin includes a spring for returning the keeper pin to an extended position. Upon moving the hook member 120 to an open or released configuration, the raised edges adjacent the groove 128 compress the detent 131 within the post 134. The detent 131 springs or returns to its extended configuration once the groove 128 aligns with the detent 131 to maintain the hook member 120 in the open configuration.

The hook member 120 includes a hook plane 125 opposite each jaw 126 at the end of the clamp 124 opposite the hook portion 122. The hook plane 125 provides a smooth edge for adjusting the position of the hook member 120 along the front surface 112 of the elongated bracket 110. The hook assembly provides for adjustment via opening the hook member 120 so that the hook plane 125 is substantially parallel with the front surface 112 of the elongated bracket 110 as in FIG. 4. That is, the hook member 120 is opened by lifting the hook member 120 away from the front surface 112 of the elongated bracket 110. Opening, or lifting, the hook member 120 releases the serrated teeth 138 from the serrations 212 on the rear surface 210 of the elongated bracket 110 and provides for sliding the hook assembly along the front surface 112 of the elongated bracket 110. Additionally, opening the hook member 120 causes the raised edges of the groove 128 of the end jaws 126 to depress the detent 131 on either side of the post 134 of the hook fastener 130. Once the hook plane 125 is substantially parallel with the front surface 112 of the elongated bracket 110, the detent 131 releases via spring action into its normal position and locks the hook member 120 in the open or released configuration. In the open configuration the hook member 120 extends in a generally perpendicular direction from the front surface 112 of the elongated bracket 110.

In another embodiment, the detent 131 is a raised surface that is sized to fit within the groove 128 in the jaws 126 of the clamp 124. That is, when the hook member 120 is opened so that the hook plane 125 is substantially parallel with the front surface, the detent 131 and the groove 128 will combine in a manner that the hook member 120 snaps into place. In one such embodiment, the hook fastener 130 is manufactured via injection molding into a single unit.

With the hook member 120 in the open configuration, the hook member 120 is operable as a lever or handle for adjusting the hook assembly along the elongated bracket 110. In the open configuration the clamp 124 occupies a narrower width between the base 132 and the lugs 136 of the hook fastener 130 than in the closed configuration. This open configuration provides for a hook member 120 that is generally perpendicular with the elongated bracket 110. In one embodiment, the hook member 120 has an angle of approximately 84° from the front surface 112 of the elongated bracket 110. The open configuration provides for pushing the hook member 120 toward the front surface 112 to further release the serrated teeth 138 from the serrations 212 of the rear surface 210 of the elongated bracket 110. Since the hook plane 125 is substantially parallel with the front surface 112, the hook assembly is easily adjusted by sliding it along the elongated bracket 110 in either direction to another position. In one embodiment, the post 134 includes a smooth surface due an injection molding process so that the post 134 slides easily along the elongated slot 116 without undue friction.

Once the hook assembly is moved to a new position along the elongated bracket 110, the hook assembly is locked into the new position by pressing, or forcing, the hook member 120 into the closed position as in FIG. 5. The pressing action provides lever functionality for securing the hook assembly in place. The corresponding actions of lifting and pressing the hook member 120 provides lever functionality for releasing the hook assembly from a location or position and then for securing the hook assembly in place.

The lever action created by pressing the hook member 120 to a closed position depresses each detent 131 to disengage the respective detent 131 from the groove 128 and the cam 127 increases the width occupied by the clamp 124 between the base 132 and the lugs 136. That is, the hook member 120 provides leverage to cause the cam 127 to increase the width between the base 132 and the lugs 136. This pressing of the hook member 120 to a closed configuration enables the cam 127 so that the lugs 136 are forced away from the front surface 112 of the elongated bracket 110. The cam 127 also compresses the serrated teeth 138 of the base 132 against the serrations 212 of the rear surface 210 of the elongated bracket 110 and locks the hook assembly in place. The hook assembly position in the elongated slot 116 is easily readjusted via the lever functionality of the hook member 120. The hook member 120 is operable as a lever for lifting the hook member 120 into the open configuration, sliding or adjusting the hook assembly to a different location, and again closing the hook member 120 against the front surface 112 of the elongated bracket 110.

It should also be appreciated that the precision of adjustment for the hook assembly is related to the dimensions of the serrated teeth 138 of the base 132 and the corresponding serrations 212 of the rear surface 212 of the elongated bracket 110. In one embodiment the shape and size of the serrated teeth 138 correspond to the shape and size of the serrations 212 so that the serrated teeth 138 fit within the serrations 212 when the hook assembly is fitted securely to the elongated bracket 110. In such an embodiment, smaller spacing between the serrated teeth 138 and correspondingly smaller spacing between serrations 212 provide for increased precision of adjustment for the hook assembly. Similarly, larger spacing between the serrated teeth 138 and correspondingly larger spacing between serrations 212 provide for decreased precision of adjustment for the hook assembly. As will be appreciated by those of skill in the art, the precision with which the hook assembly may be adjusted is inversely proportional to the spacing between the serrated teeth 138 and their corresponding serrations 212.

Figures 6, 7, 8, 9:
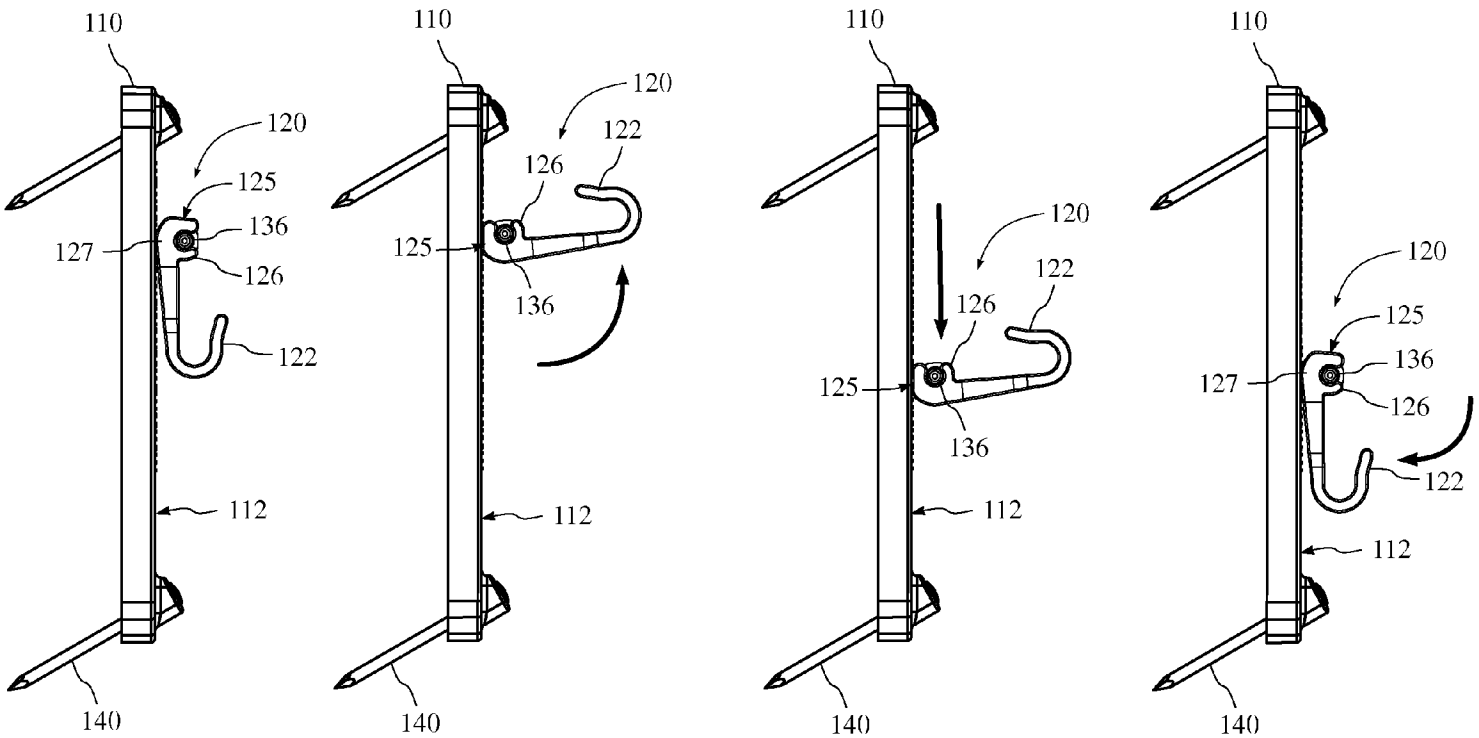
FIG. 6 is a side view of the adjustable wall hanger with the hook member in a closed configuration.
FIG. 7 is a side view of the adjustable wall hanger with the hook member in an open configuration.
FIG. 8 is a side view of the adjustable wall hanger with the hook member in an open configuration during position adjustment from FIG. 7.
FIG. 9 is a side view of the adjustable wall hanger with the hook member in a closed configuration and at a different position from FIG. 6.

FIG. 6 is a side view of the adjustable wall hanger 100 with the hook member 120 in a closed configuration. FIG. 7 is a side view of the adjustable wall hanger 100 with the hook member 120 in an open configuration. FIG. 8 is a side view of the adjustable wall hanger 100 with the hook member 120 in an open configuration during position adjustment from the position shown in FIG. 7. FIG. 9 is a side view of the adjustable wall hanger 100 with the hook member 120 in a closed configuration and at a different position from that shown in FIG. 6. FIG. 6 through FIG. 9 together illustrate the adjustment of the adjustable wall hanger 100 from an initial position via opening the hook member 120, pressing the hook member 120 toward the front surface 112 of the elongated bracket 110, sliding the hook member 120 to a new position, and closing the hook member 120 to lock the adjustable wall hanger 100 in place.

When the hook member 120 is closed, that is pressed against the front surface 112 of the elongated bracket 110, the hook assembly is stable and locked into position. When the hook plane 125 is parallel with or adjacent to the front surface 112 of the elongated bracket 110, the hook member 120 is disengaged or open and provides for positioning the hook member along the elongated slot 116 of the elongated bracket 110. It should be noted that the hook assembly is not movable unless the hook member 120 is in the open position.

As shown in FIG. 5 and FIG. 9, it is apparent that closing the hook member 120 enables the cam 127 of the clamp 124 and tightens the serrated teeth 138 against the serrations 212 of the rear surface 210 of the elongated bracket 110. Once the hook member 120 is in the closed configuration the hook assembly is locked into position.

In operation, opening the hook member 120 provides for positioning the hook assembly along the front surface 112 of the elongated bracket 110. The groups of markings 118 are used for additional positioning guidance. Once the hook assembly is in position, the hook member 120 is closed to lock the hook assembly in position. If further adjustments are necessary, the hook member 120 is opened, the hook assembly position is adjusted, and then the hook member 120 is closed to lock the position.

From the foregoing description, it will be recognized by those skilled in the art that an adjustable wall hanger 100 for hanging pictures, tools, utensils, and the like on a wall or other flat surface has been provided. The adjustable wall hanger 100 provides for adjustment of the height of a picture or other object without removing the adjustable wall hanger 100 from the wall.

The adjustable wall hanger includes various functions. The function of spring functionality in a detent 131 is provided for example by a keeper pin.

The function of tightening the serrated teeth 138 against the serrations 212 is provided by a cam 127 portion of the clamp 124.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An adjustable wall hanger, comprising:

an elongated bracket having a front surface and a rear surface, said front surface including at least one group of marks for position guidance, and said rear surface including a plurality of serrations;

at least one mounting member near at least one end of said elongated bracket, wherein each at least one mounting member includes a hole to receive a fastener for affixing the adjustable wall hanger to a fixed surface;

an elongated slot extending at least a portion of distance between each end of said elongated bracket;

a hook assembly that includes a hook member and a hook fastener, said hook member having adjustable configurations when secured by said hook fastener, wherein said hook member includes a hook portion distal from a clamp portion, said clamp portion including a pair of jaw sections separated by an opening, each jaw section including at least two jaws, said clamp portion further including a planar surface proximal said jaws and opposite said hook portion, said clamp portion further including a cam portion opposite said jaws;

wherein said hook fastener includes a base with a post extending distally therefrom, said base further including serrated teeth proximal said post, said hook fastener further including lugs extending from opposite sides of said post and distal from said base, said post further including at least one detent between said base and said lugs;

wherein said adjustable configurations include a closed configuration with said hook member against said front surface, wherein said cam engages to compress said serrated teeth to said serrations to lock said hook assembly in position, and an open configuration with said planar surface against said front surface so that said hook assembly is movable along said elongated slot, wherein said post extends through said elongated slot so that said lugs fit within said jaws to secure said hook member to said fastener and to said elongated bracket.

2. The adjustable wall hanger of claim 1 said detent further comprising means for spring functionality so that said detent is compressible within said post and rests in an extended position when uncompressed.

3. The adjustable wall hanger of claim 1 further comprising a groove on at least one jaw, wherein said grove aligns with said detent to lock said hook member in an open position.

4. The adjustable wall hanger of claim 1 wherein said front surface is a smooth surface and wherein said planar surface is a smooth surface to provide for said hook member to slide along said front surface.

5. The adjustable wall hanger of claim 1 wherein each at least one mounting member is angled so that a fastener extending through said hole forms an angle of substantially 60° relative to said elongated bracket.

6. The adjustable wall hanger of claim 1 wherein said fastener is one a group comprising a nail, a screw, a bolt.

7. An adjustable wall hanger, comprising:

an elongated bracket having a front surface and a rear surface, said front surface including at least one group of marks for position guidance, and said rear surface including a plurality of serrations;

at least one mounting member near at least one end of said elongated bracket, wherein each at least one mounting member includes a hole to receive a fastener for affixing the adjustable wall hanger to a fixed surface;

an elongated slot extending at least a portion of distance between each end of said elongated bracket;

a hook member having a closed configuration and an open configuration, said hook member including a hook portion distal from a clamp portion, wherein said clamp portion includes a pair of jaw sections separated by an opening, each jaw section including at least two jaws; and a hook fastener for securing said hook member to said elongated bracket;

wherein when said hook member is secured by said hook fastener, said open configuration provides for adjusting position of said hook along said elongated slot, and wherein said closed configuration locks said hook member in position to said elongated bracket.

8. The adjustable wall hanger of claim 7 said clamp portion further including a planar surface proximal said jaws and opposite said hook portion.

9. The adjustable wall hanger of claim 8 said hook fastener further comprising a base with a post extending distally therefrom, said base further including serrated teeth proximal said post, said post further including lugs extending from opposite sides and distal from said base.

10. The adjustable wall hanger of claim 9 said post further comprising at least one detent between said base and said lugs.

11. The adjustable wall hanger of claim 9 said clamp portion further including a cam portion opposite said jaws, wherein said cam is operable to compress said serrated teeth against said serrations to lock said hook member in position.

12. The adjustable wall hanger of claim 8 wherein said open configuration further includes said planar surface pressed against said front surface so that said hook member is movable along said elongated slot.

13. The adjustable wall hanger of claim 10 said detent further comprising means for spring functionality so that said detent is compressible within said post and rests in an extended position when uncompressed.

14. The adjustable wall hanger of claim 13 further comprising a groove on at least one jaw, wherein said groove aligns with said detent to lock said hook member in an open position.

15. The adjustable wall hanger of claim 7 wherein each at least one mounting member is angled so that a fastener extending through said hole forms an angle of substantially 60° relative to said elongated bracket.

16. The adjustable wall hanger of claim 7 wherein said fastener is one a group comprising a nail, a screw, a bolt.

* * * * *